United States Patent [19]

Gabry

[11] 4,114,674

[45] Sep. 19, 1978

[54] EXPANDABLE DOOR

[76] Inventor: Frank F. Gabry, 9841 N. Elms Ter., Des Plaines, Ill. 60016

[21] Appl. No.: 753,592

[22] Filed: Dec. 23, 1976

Related U.S. Application Data

[63] Continuation-in-part of Ser. No. 689,537, May 24, 1976, abandoned.

[51] Int. Cl.[2] ..... E06B 9/00; E06B 3/12

[52] U.S. Cl. ..... 160/222; 160/197; 160/202

[58] Field of Search ..... 160/193, 202, 197, 220, 160/222, 223, 229 B

[56] References Cited

U.S. PATENT DOCUMENTS

| | | | |
|---|---|---|---|
| 1,598,471 | 8/1926 | Williams | 160/222 |
| 2,057,850 | 10/1936 | Sims | 160/193 |
| 2,891,616 | 6/1959 | Nelson | 160/222 |

FOREIGN PATENT DOCUMENTS

| | | | |
|---|---|---|---|
| 1,542,716 | 9/1967 | France | 160/220 |

*Primary Examiner*—Peter M. Caun

*Attorney, Agent, or Firm*—Alter and Weiss

[57] ABSTRACT

An expandable door features vertically telescoping door sections, having flexible wire guides to insure engagement of the door sections during raising and lowering operations, with a minimum of physical contact and force exerted between adjacent sections. The wire guides are uniquely shaped to assure engagement of the door sections, even when said sections become misaligned; this unique shape also allows ease of constructions and repair. The door sections may be either generally U-shaped or L-shaped, and nest one within the other when the door is opened.

4 Claims, 6 Drawing Figures

EXPANDABLE DOOR

This is a continuation-in-part of my application Ser. No. 689,537, filed on May 24, 1976, and since abandoned. This invention relates generally to sectional overhead doors, and more particularly to vertically telescoping sectional doors, featuring flexible wire guide means between vertically adjacent door sections.

Overhead doors fashioned from vertically telescoping door sections are generally mechanically simpler and require less installation space than do conventional sectional track-mounted overhead doors. A vertically telescoping overhead door obviates the need for space-consuming and difficult-to-align overhead tracks to guide the door sections during opening and closing operations. Instead, the vertically telescoping door sections nest one within the other as the door is raised, effectively storing an entire door closure in a space the size of the uppermost door section, or, if desired, within the door jamb itself.

Previous telescoping door concepts such as those illustrated in the U.S. Pat. Nos.3,430,676 and 3,698,465 require sufficient physical contact between adjacent U-shaped door sections to force the depending legs of the suprajacent section outward in order to guide the door sections and hold them rigidly when the door is in a closed attitude. Such an arrangement requires the door sections to deform, and inevitably introduces a large amount of friction between moving door sections, ultimately marring the exterior surfaces of the door sections after continuous opening and closing. Such door closures also require that the individual door sections be of substantially a U-shape in cross-section, and efficient operation depends upon continuing elasticity with which the door sections deform.

Further complicating the construction and operation of such doors is the requirement that the door sections, while required to be sufficiently resilient to withstand constant deformation during opening and closing, must at the same time be sufficiently rigid to assure effective operation of the guide means used to keep the sections aligned during opening and closing. Sectional doors such as are taught in U.S. Pat. No. 3,304,994 require rigid channels fastened to each door section into which mating slides must be mounted to guide the door sections during opening and closing operations. Similarly, the doors illustrated in U.S. Pat. Nos. 9,126,288 and 3,204,691 feature rigid bolts or rods passing through holes formed in the upper and lower surfaces of each door section. Such constructions give rise to a serious set of problems which occurs when door sections are bent or become laterally misaligned during opening or closing operations. It is not uncommon for the door sections to bind on the rigid guide systems used, jamming the door, thereby putting it out of operation.

Accordingly, the present invention has the following objects:

- To provide vertically telescoping door closures whose operation is not dependent upon force or pressure exerted by individual door sections in immediately suprajacent door sections;
- To provide such closures available in U-shaped, as well as substantially L-shaped cross-section;
- To provide such closures with guide means operative during opening and closing;
- To provide such closures with positively engaging inter-connections upon opening and closing;

- To provide such closures with guides comprising uniquely shaped flexible wires;
- To provide such closures in forms utilizable with flexible individual panels;
- To provide such closures in forms economical to manufacture and maintain; and
- To provide such door closures in versions using identically dimensioned door sections.

These and further objects will become more apparent upon consideration of the accompanying drawings, in which.

Figure 1:
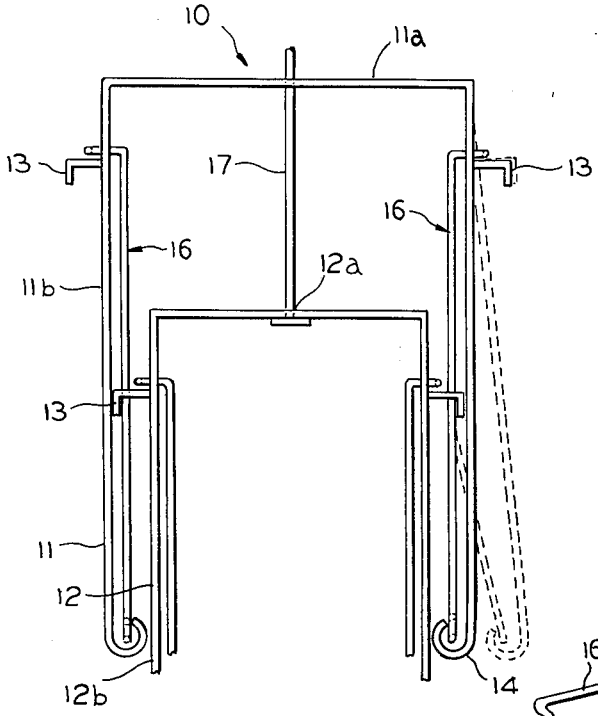
FIG. 1 is a cross-sectional view of a first embodiment of the present invention illustrating a U-shaped configuration.

Consistent with the foregoing objects, a vertically expandable door closure 10 is provided, having a plurality of individual door sections 11, with guide hook means 13 engageable with lip means 14 on suprajacent door sections. Guide means 16 are provided on each section to assure engagement of hook means 13 and lip means 14 during raising and lowering operations. Said guide means comprises flexible wire means 16 passing through guide appertures 18 formed in hook means 13 and secured at one end by passage through slot 19, and at the other end by passage along lip 14 and crimping at 15.

Figure 4:
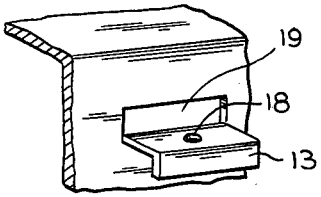
FIG. 4 is a detail of the combination hook and guide bracket of FIG. 1.
Figure 6:
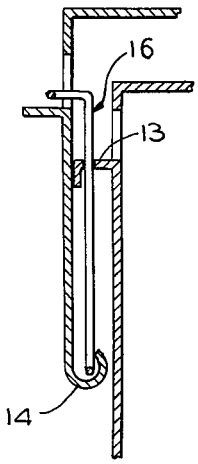
FIG. 6 is a section view along 5—5 of FIG. 5.

Referring now to FIG. 1, the numeral 10 indicates generally two adjacent U-shaped door sections 11 and 12, with door section 11 suprajacent to door section 12. Each section is fashioned with a base, 11*a* and 12*a*, respectively, from which depend legs 11*b* and 12*b* respectively. Formed on each such depending leg near each such base are guide hooks 13. Said guide hooks may be formed integrally with each said section by stamping out a portion thereof and bending it into the configuration shown, thereby leaving section slot 19, as shown in FIG. 4. At the lowermost portion of each such depending leg is formed curved lip 14, shaped to positively engage guide hooks 13 as, in FIG. 6, door section 12 is lowered. Other successively nested sections may similarly be supported until the entire door is in a lowered attitude. The raising and the lowering of door sections may be controlled by a cable arrangement such as that illustrated at 17 attached to the lowermost door section activated by a conventional winding mechanism not herein illustrated.

Figure 3:
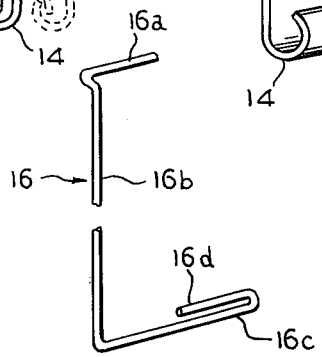
FIG. 3 is a perspective view of the flexible wire guide.

To insure engagement of guide hooks 13 with curved lip 14, flexible wire guides 16, as illustrated in FIG. 3, are provided. Guides 16 are formed in this embodiment with a single horizontal run 16*a*, a single run 16*b* depending therefrom, and a horizontal run 16*c* extending generally horizontally from 16*b* and doubling back for a portion of its length as illustrated at 16*d*. Each such guide 16 is formed of wire material sufficiently stiff yet resilient to allow guide 16 to resume its original configuration after having been deformed.

Figure 5:
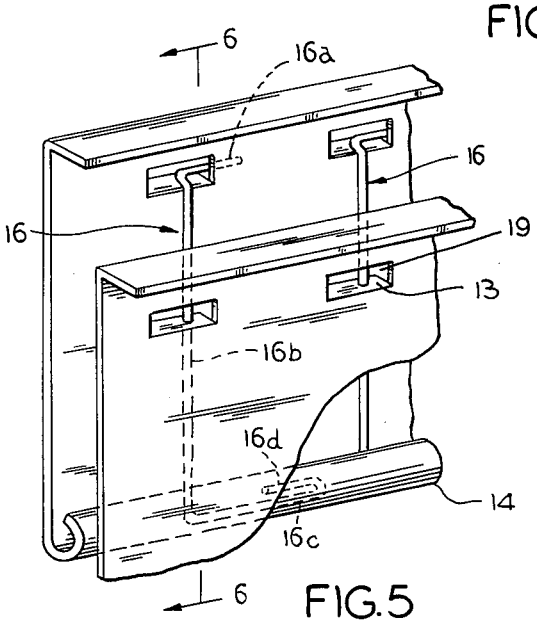
FIG. 5 is a partial perspective of the closure illustrated in FIG. 1.

As illustrated in this embodiment at FIG. 5, each guide 16 is passed through guide hook 13 of subjacent section 12 and is thence secured to suprajacent panel 11 by passing run 16a through slot 19 and by inserting run 16c into the channel formed by lip 14. Lip 14 may then be crimped as at 15 to more securely hold guide 16 in position. Each spring guide 16 may further be formed with a "step" as at 16e, to facilitate passage of wire 16 through slot 19 and to pre-flex run 16a to press upon section 11 when installed, thereby helping to more firmly hold wire 16 in place.

Thus, in this embodiment, contact between suprajacent door sections during opening and closing operations is effectively limited to contact between guide hooks 13 and curved lips 14. Operation of an overhead door formed from sections similar to 11 and 12 is thus not dependent upon any force or pressure exerted by a door section on its immediately suprajacent partner, and similarly is independent of any rigid system of door guides.

Figure 2:
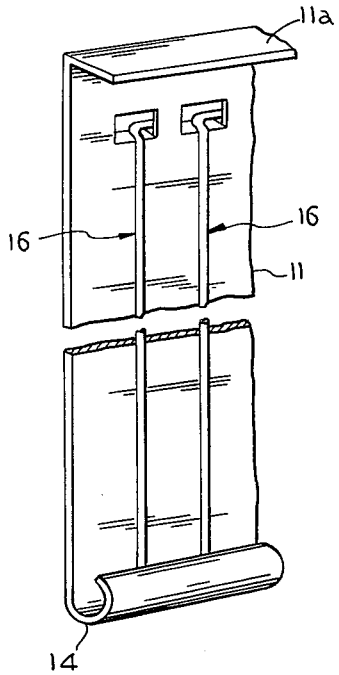
FIG. 2 is a partial perspective of a second embodiment illustrating an L-shaped configuration.

Incorporation of wire guide means in a vertically telescoping door closure not only assures more positive operation of the door closure, but also makes possible construction of individual door sections in the cross sectional configurations other than "U-shaped". As taught in U.S. Pat. Nos. 3,430,676 and 3,698,465, previous telescoping door closures have not only adopted, but required, some form of U-shaped cross-section with the depending legs of each door section functioning as a guide means by contacting the legs of the immediately suprajacent section, or have required rigid, non-flexible, bolt-type guides for non-U-shaped sections. Guide means of the type described herein make possible the manufacture of substantially L-shaped sections as illustrated in FIGS. 2 and 5, which utilize less than one-half the material used to construct a more conventional U-shaped door section. The guide means illustrated herein provides the door sections with a positively acting guide system with minimized physical contact between adjacent sections. Such a cross-sectional configuration also serves to simplify construction of such expandable telescoping doors, since the individual door panels may all be substantially the same size rather than as in the case of the U-shaped door section, where the uppermost door section must be larger than the one directly beneath it and in which such gradations in size must continue for the entire length of the door.

Thus, the L-shaped or "shingle" door with the described guide means offers significant advantages over a more conventionally U-shaped door, primarily in the amount of material needed to construct the door with consequent savings in weight, the interchangeability of door panels and the simplicity and ease of construction. As with other more conventional overhead doors, safety features, such as microswitches, utilizable to interrupt door operation when the door encounters an obstacle, door lock systems, automatic closure systems, and the like may readily be adapted for use with the door closures described herein.

As can readily be seen, construction and disassembly of vertical overhead closures is greatly simplified through use of flexible wire guides. Should individual sections become damaged or defaced, replacement is faciliated by the ease with which wire guides 16 may be removed and a new door section reinstalled. Because such guides are flexible, operation of the closure is facilitated in circumstances under which the individual sections may become misaligned during operation. As illustrated in phantom at FIG. 1, individual door sections may flex considerably yet wire guides 16 will continue to effectively assure engagement of guide hooks 13 with lip 14. Such flexibility also allows a degree of lateral movement of the individual door sections.

Though the foregoing has presented specific embodiments of the invention, it is to be understood that these embodiments are offered by way of example only and are not intended to limit the scope of the invention. It is expected that others skilled in the art may perceive variations from the foregoing which do not depart from the spirit and scope of the invention.

I claim:

1. A vertically expandable door closure, comprising:
a plurality of door sections,
means to suspend said sections one from the other when said door closure is in a closed position,
each said section having a base and at least one leg depending therefrom;
said suspension means including a channel formed on each said section,
said channel extending along the lowermost edge of each said leg;
said suspension means further including at least one guide hook formed on each said section,
each said guide hook extending from one said leg intermediate said channel and said base,
each said guide hook shaped, sized, and positioned to engage the channel of an immediately suprajacent section,
each said guide hook having a guide aperture formed therethrough;
a plurality of flexible wire struts,
at least one of said struts being respectively mounted to each of said sections,
each said strut including a first substantially horizontal segment,
said first segment engaging the leg of said section,
a second segment continuous with and depending from said first segment,
said second segment being offset from said first segment,
said second segment passing through one said guide hook aperture on an immediately subjacent section,
a third segment continuous with said second segment and extending horizontally therefrom,
said third segment engaging said channel along said lowermost edge of said section when said first segment engages said leg,
each said wire strut directing said guide hook along said second segment to positively engage said guide hook with the channel of an immediately suprajacent section during closing of said door closure.

2. The apparatus as recited in claim 1 wherein each said wire strut further includes a fourth segment,
said fourth segment curving back toward and substantially parallel to said third segment, said fourth segment and said third segment being spaced apart.

3. The apparatus as recited in claim 1 wherein each said leg has a guide slot formed therethrough,
said guide slot shaped and dimensioned to frictionally accommodate said first segment, whereby said first segment passes through said section at said guide slot.

4. The apparatus as recited in claim 1 wherein said struts are frictionally secured to said sections without requiring the use of additional fasteners.

* * * * *